United States Patent [19]

Ito et al.

[11] Patent Number: 4,897,695

[45] Date of Patent: Jan. 30, 1990

[54] COPYING MACHINE

[75] Inventors: Masazumi Ito; Yoshihiro Horie, both of Osaka, Japan

[73] Assignee: Minolta Camera Kabushiki Kaisha, Osaka, Japan

[21] Appl. No.: 293,878

[22] Filed: Jan. 5, 1989

[30] Foreign Application Priority Data

Jan. 6, 1988 [JP] Japan ..... 63-1091

[51] Int. Cl.[4] ..... G03G 15/04

[52] U.S. Cl. ..... 355/233; 355/243

[58] Field of Search ..... 355/233, 243, 311, 25, 355/55, 57, 60

[56] References Cited

U.S. PATENT DOCUMENTS

| | | | |
|---|---|---|---|
| 4,052,054 | 10/1977 | Cardwell | 271/227 |
| 4,595,273 | 6/1986 | Watanabe | 355/233 X |
| 4,595,286 | 6/1986 | Yamazaki | 355/233 X |
| 4,657,375 | 4/1987 | Watanabe | 355/233 X |
| 4,659,207 | 4/1987 | Maekawa | 355/233 X |
| 4,739,372 | 4/1988 | Watanabe | 355/233 X |
| 4,743,946 | 5/1988 | Nishimori et al. | 355/233 X |
| 4,758,866 | 7/1988 | Ito | 355/55 X |
| 4,831,412 | 5/1989 | Ohnishi et al. | 355/233 |

*Primary Examiner*—R. L. Moses

*Attorney, Agent, or Firm*—Willian Brinks Olds Hofer Gilson & Lione

[57] ABSTRACT

A copying machine which can scan an original document in selectable modes including a mode in which a first half portion and a second half portion of the document are scanned to form the image of each portion on the photosensitive member, wherein a paper size and a desired magnification are automatically set by a paper size detecting means, thereby copying a first half portion and a second half portion of the document on separate papers.

11 Claims, 19 Drawing Sheets

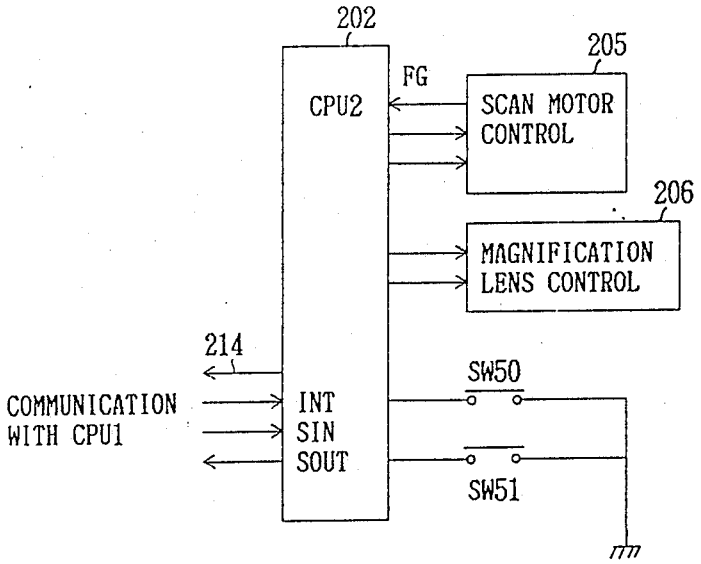
F I G. 5 (1)
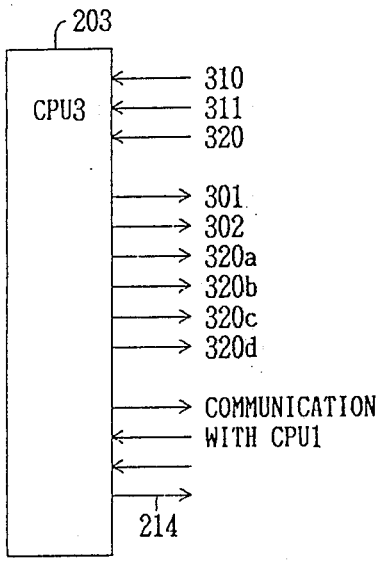
F I G. 5 (2)
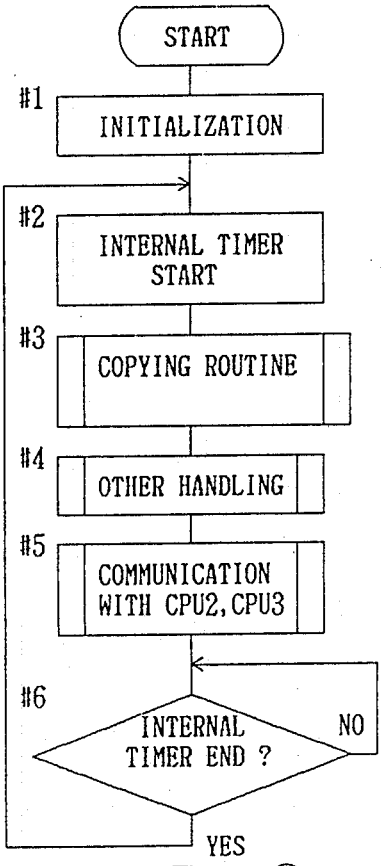
F I G. 6

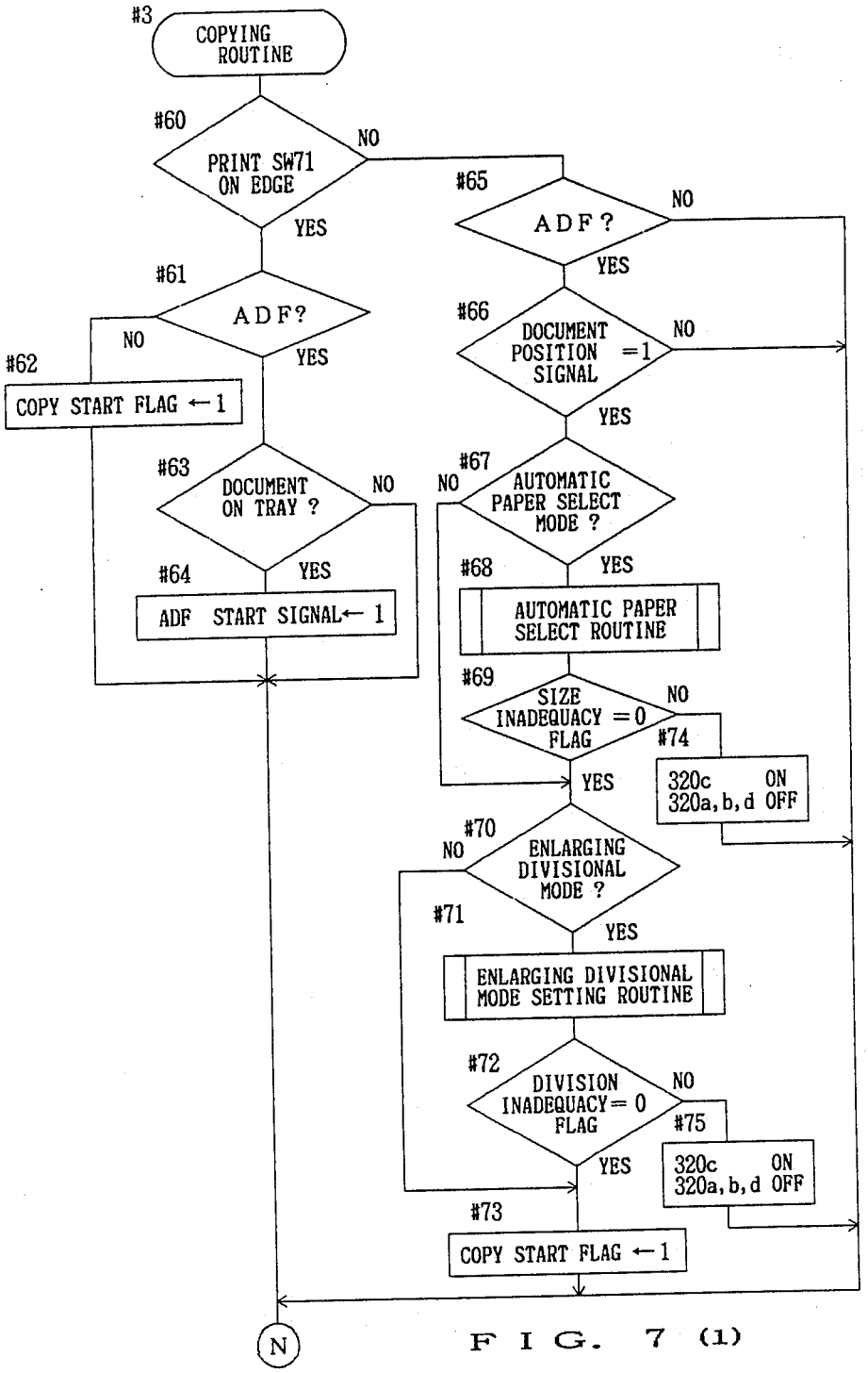
FIG. 7 (1)

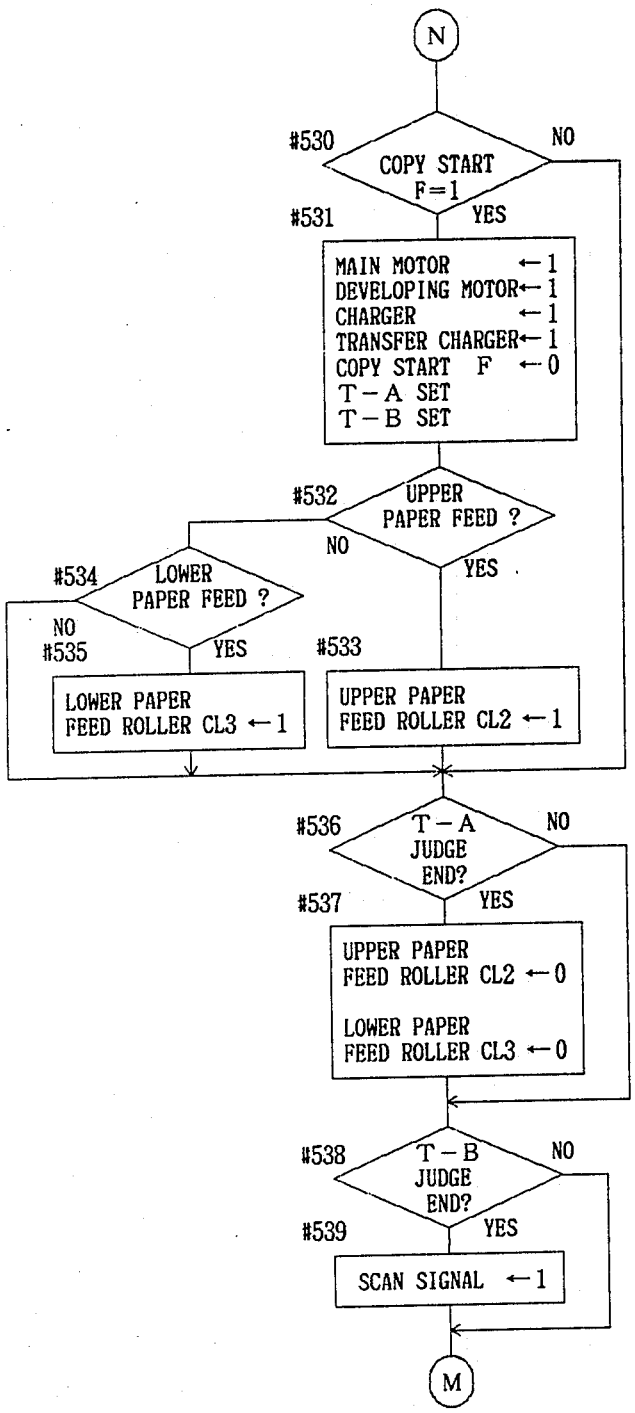
F I G. 7 (2)

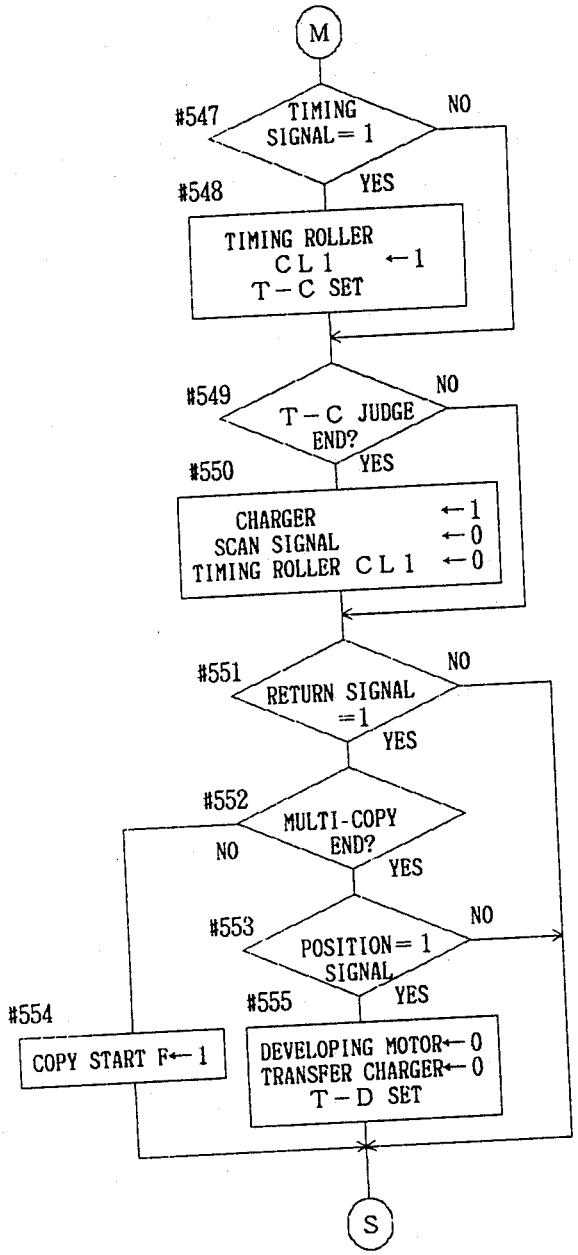
FIG. 7 (3)

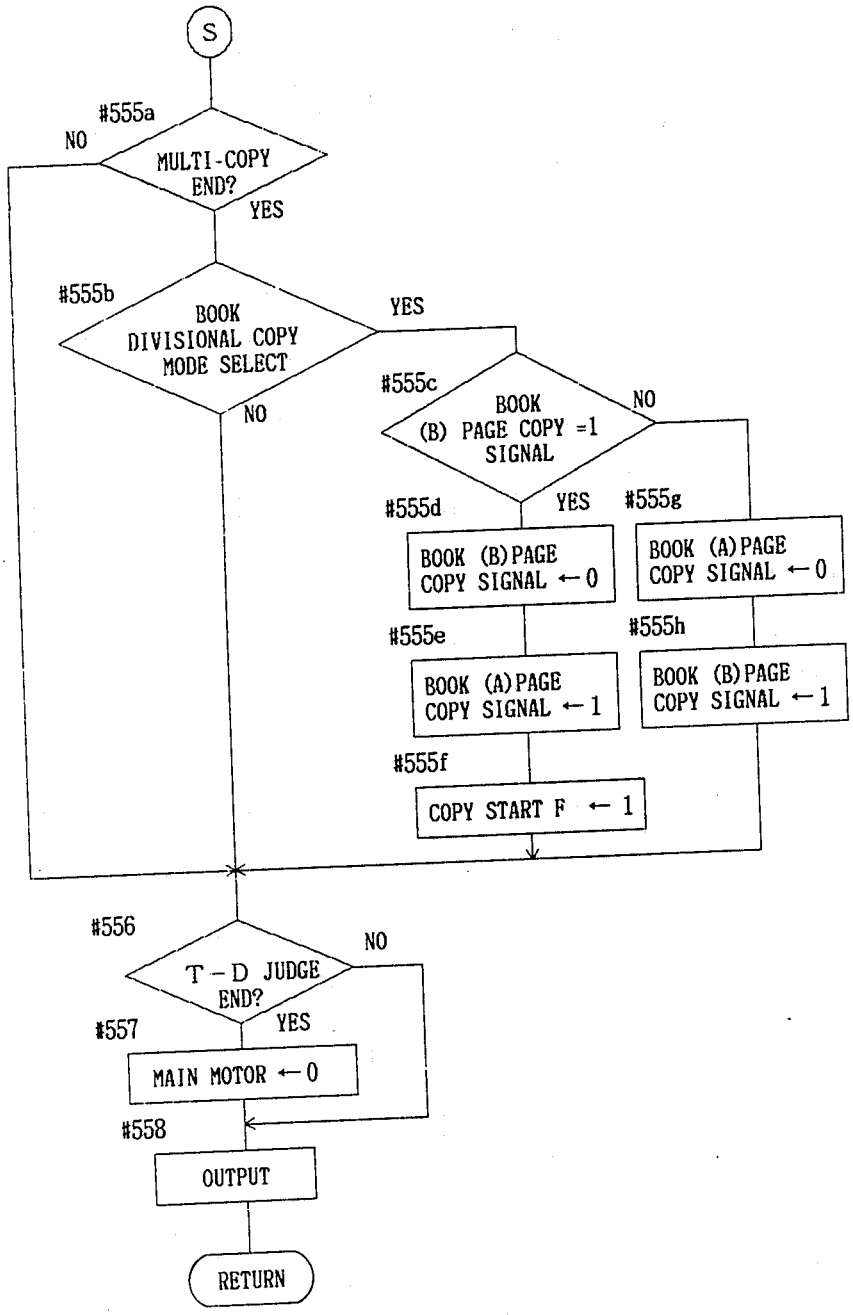
F I G. 7 (4)

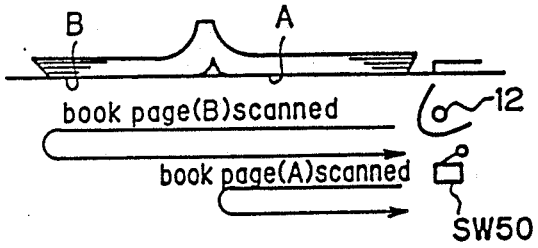
F I G. 1 2
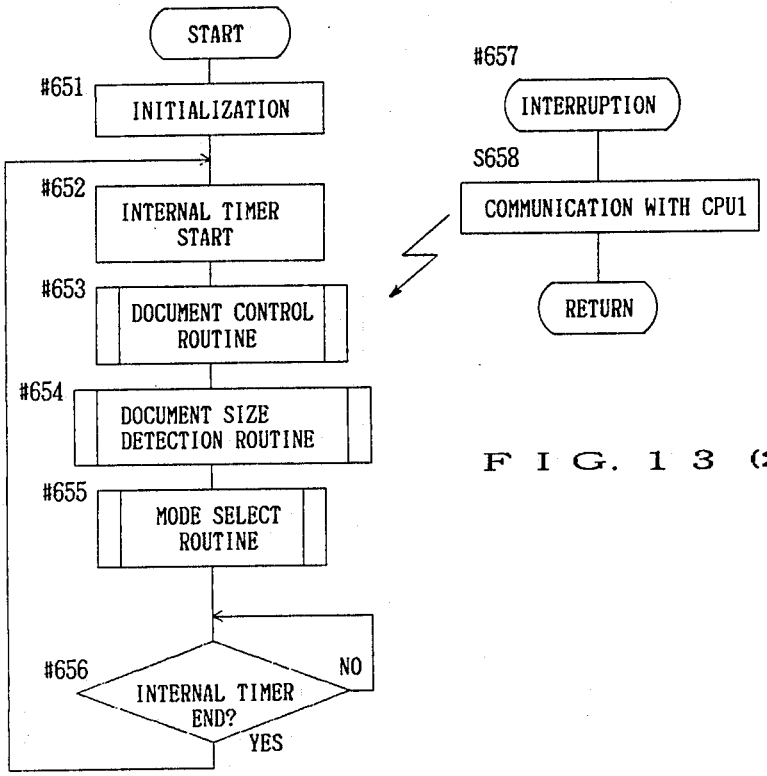
F I G. 1 3 (2)
F I G. 1 3 (1)

(NOTE) Lo: LONGITUDINAL
La: LATERAL

COPYING MACHINE

BACKGROUND OF THE INVENTION

The present invention relates to a copying machine, and more particularly to a copying machine including a divisional copying system.

To explain the background of the present invention, reference is made to FIG. 19, which shows two longitudinal A4 papers placed side by side on a glass panel (not shown) so as to copy the letters (or any other items) therein on a single lateral A4 paper on a reduced scale. The reduction of image size outputs the copy in the A4 size as shown in FIG. 19. Nowadays this copying method is well known and widely used.

The reduction in image size is advantageous in that the paper cost and the filing space are saved. On the other hand, disadvantages result: one is that an image reduced in scale is difficult to read, and the other is that longitudinal A4 paper and lateral A4 paper are not suited for filing in the same folder because of requiring different visual angles to read. To solve this problem, it is required to restore the reduced image size to the original one. In the case of FIG. 19 the left-hand half portion and the right-hand half portion of the lateral A4 paper are to be respectively copied on a single longitudinal A4 paper on an enlarged scale. To achieve this, at least three selecting operations are required: that is, to select a book divisional copying mode, an appropriate magnification and a paper size. There are copying machines which can operate these three selections, but the selection is complex to operate and consumes time and labor.

SUMMARY OF THE INVENTION

The present invention is directed toward a copying machine which solves the problems pointed out above. Thus an object of the present invention is to provide a copying machine including a divisional copying system easy to operate without any special skill.

According to one aspect of the present invention, there is provided a copying machine which comprises a rotatable photosensitive member; means for supporting a document placed for copying; a scanning means for scanning the document positioned on the supporting means, wherein the document is scanned either in a first mode in which a first half portion and a second half portion thereof in the scanning direction are separately scanned so as to transmit the image of each portion on the photosensitive member, or in a second mode in which the entire surface of the document is scanned so as to transmit an image thereof on the photosensitive member; means for varying a magnification of the image formed on the photo-sensitive member; at least two cassettes for containing copy papers of various sizes; means for detecting the sizes of the papers contained in each cassette; means for detecting the size of the original document; means for selecting an enlarging divisional copying mode so as to divide an image of the document into two parts and copy each part on an enlarged scale; and control means for automatically setting a magnification and a paper size corresponding to the document size detected by the document size detecting means, and for copying the images of the first half portion and the second half portion of the document on separate papers in the first scan mode.

The scanner reciprocally moves along the entire surface of the document from a reference position so as to scan a first portion thereof, and reciprocally moves along a second portion of the document from the reference position so as to scan the second portion.

The document can be also supplied by hand, but is normally supplied by a document feeding means which transports and positions a document on the supporting means.

The document size detecting means detects the document size while the document is transported. The detection of a document size is effected by a sensor responsive of the passage of the document.

The enlarging divisional copying mode is selectable when the document feeding means is relied upon. The selection is made by means including a mode selection key, which is preferably disposed on the document feeding means.

In the enlarging divisional copying mode the paper size is normally equal to that of a document, but various paper sizes can be selected.

The paper size detecting means detects a paper size in the cassette through the on/off-operations of switches included therein, wherein the on/off-operations are states in which some switches are on and the others are off alternatively responsive of particular paper sizes.

There can be provided a second paper size detecting means which can detect whether the paper in the cassette takes a longitudinal posture or a lateral posture with respect to the direction of paper feed.

The copying machine can further include a first means for selecting a first mode in which a paper size is automatically selected corresponding to the document size detected by the document size detecting means, or a second means for selecting a second mode in which a document is manually supplied without using the document feeding means. The enlarging divisional copying mode and the first means or second means can include a common mode selection key, which is preferably disposed on the document feeding means.

Other objects and advantages of the present invention will become more apparent from the following detailed description, when taken in conjunction with the accompanying drawings which show, for the purpose of illustration only, one embodiment in accordance with the present invention.

BRIEF DESCRIPTION OF THE DRAWINGS

FIG. 5(1) is a block diagram showing the construction of a control system for the optical system;

FIG. 5(2) is a block diagram showing the construction of a control system for the ADF;

FIG. 6 is a flowchart showing a main routine executed by the CPU1 for controlling the copying machine;

FIG. 7(1) to 7(4) are flowcharts showing the copying operation;

FIG. 12 is a schematic view showing that an original document is scanned in the book divisional copying mode;

FIGS. 13(1) and 13(2) are flowcharts showing main routines executed by a CPU3 for controlling the ADF;

DETAILED DESCRIPTION OF THE PREFERRED EMBODIMENT

Figure 1:
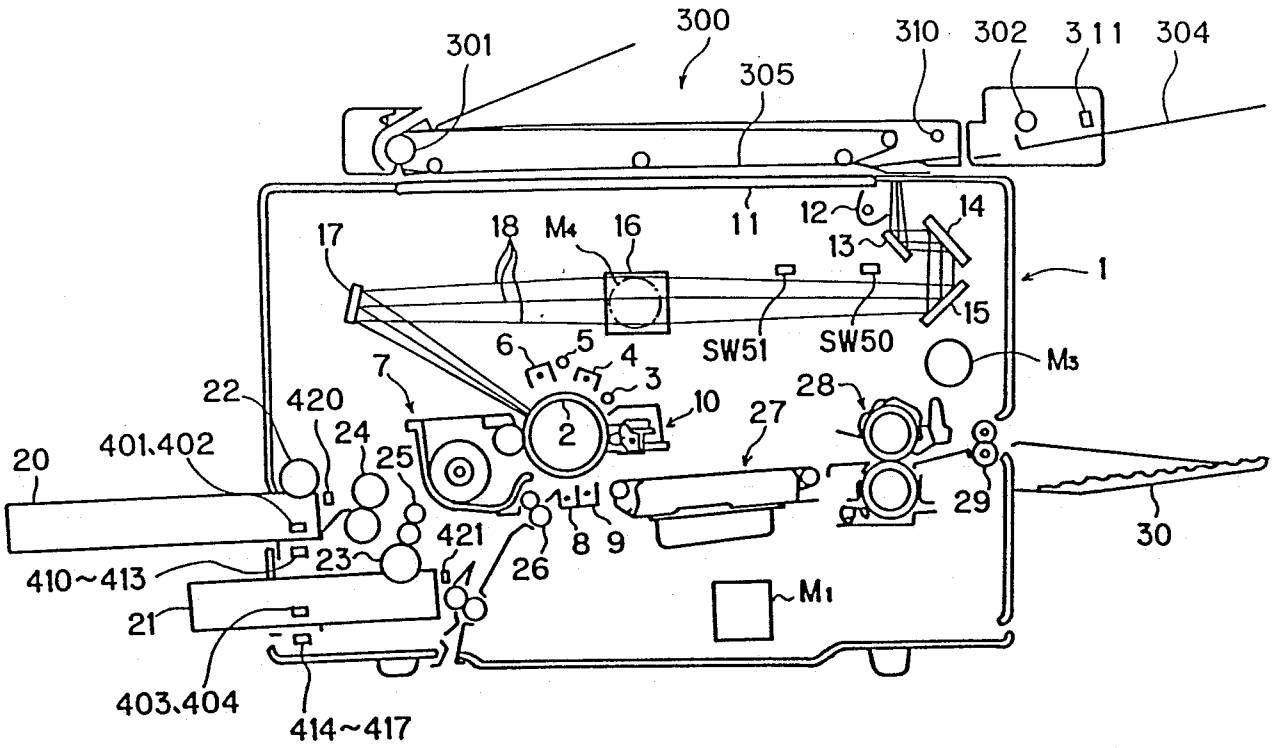
FIG. 1 is a schematic cross-sectional view showing a copying machine embodying the present invention.

Referring to the drawings, an example of the embodiment will be described in the following order:

1. Structure of the copying machine
2. Operation panels
3. Construction of a control system
4. Operation of the copying machine
   (a) Main routine
   (b) Copying operation
   (c) Automatic paper selection
   (d) Setting of an enlarging divisional copying mode
5. Operation of an optical system
6. Operation of an automatic document feeder (ADF)

Structure of The Copying Machine

Referring to FIG. 1, an electrophotographic copying machine, generally designated by the reference numeral 1, has a photosensitive drum 2, which is rotatable in a counter-clockwise direction. Disposed around the photosensitive drum 2 are a main eraser lamp 3, a sub-charger 4, a sub-eraser lamp 5, a main charger 6, a developing unit 7, a transfer charger 8, a sheet separating charger 9, and a cleaner 10. The photosensitive drum 2 has a photosensitive member (e.g. selenium) on the surface. When a copy is to be made the drum 2 is exposed to light by the eraser lamps 3 and 5, and is charged by the chargers 4 and 6. Then it is exposed to a light image by an optical system, which will be described below. The photosensitive drum 2 is driven by a main motor M1. The developing unit 7 is driven by another motor (not shown). The optical system is constructed such that an original document placed on a glass panel 11 is scanned from below. The optical system comprises a light source 12, a first mirror 13, a second mirror 14, a third mirror 15, a lens 16, and a fourth mirror 17. An image of the original document is transmitted along the lines 18 to the photosensitive drum 2 by way of the mirrors 13, 14, 15 and 17. There is provided a switch SW50 which detects whether the optical system is located at an appropriate position. An intended magnification is set by moving the lens 16 by a motor M4 in the direction of the optical axis. The optical system is moved by a motor M3. When an intended magnification is (n), the light source 12 and the first mirror 13 are moved to the left by the motor M3 at a speed v/n. corresponding to a circumferential velocity v of the photosensitive drum 2, wherein the velocity is constant irrespective of any magnification intended, that is, enlarging, reducing or 1-to-1 magnification. Simultaneously, the second mirror 14 and the third mirror 15 are moved to the left at a speed of v/2n. The photosensitive drum 2 is exposed to a light image in the form of a slit through the fourth mirror 17.

To the left of the copying machine are provided paper cassettes 20 and 21 at an upper feed port and a lower feed port, respectively. The papers stored in the cassettes 20 and 21 are selectively fed by upper feed rollers 22 and lower feed rollers 23 to the copying machine 1. The paper passes through feed rollers 24 and 25, and reaches a pair of timing rollers 26, where it stops for a moment.

The upper feed roller 22, the lower feed roller 23 and the timing rollers 26 are driven through on/off clutches CL2, CL3 and CL1 (not shown) by the main motor M1, respectively.

When the toner image is transferred, the paper fed by the timing rollers 26 is kept in contact with the photosensitive drum 2 in the transfer area, and the toner image is transferred to the paper by a corona discharge generated by the transfer charger 8. Then the paper is separated from the photosensitive drum 2 by a corona discharge generated by the paper separating charger 9, wherein the toughness of the paper is helpful in separating itself from the drum. The paper is sucked to a conveyor belt 27 by a pneumatic sucking means (not shown) and conveyed to the right by the belt 27 rotating in a clockwise direction. When the paper passes through the fixing unit 28, the toner image is fused by heat and permanently fixed to the paper. Finally the paper is fed onto a tray 30 through discharge rollers 29.

There are provided microswitches 401, 402 and 403, 404 which check the kind, color tone or any other factor of the paper stored in the cassettes 20 and 21 and judge whether it is a standard paper or not. The switches are turned on depending upon the kind by a starter (not shown).

Figure 4:
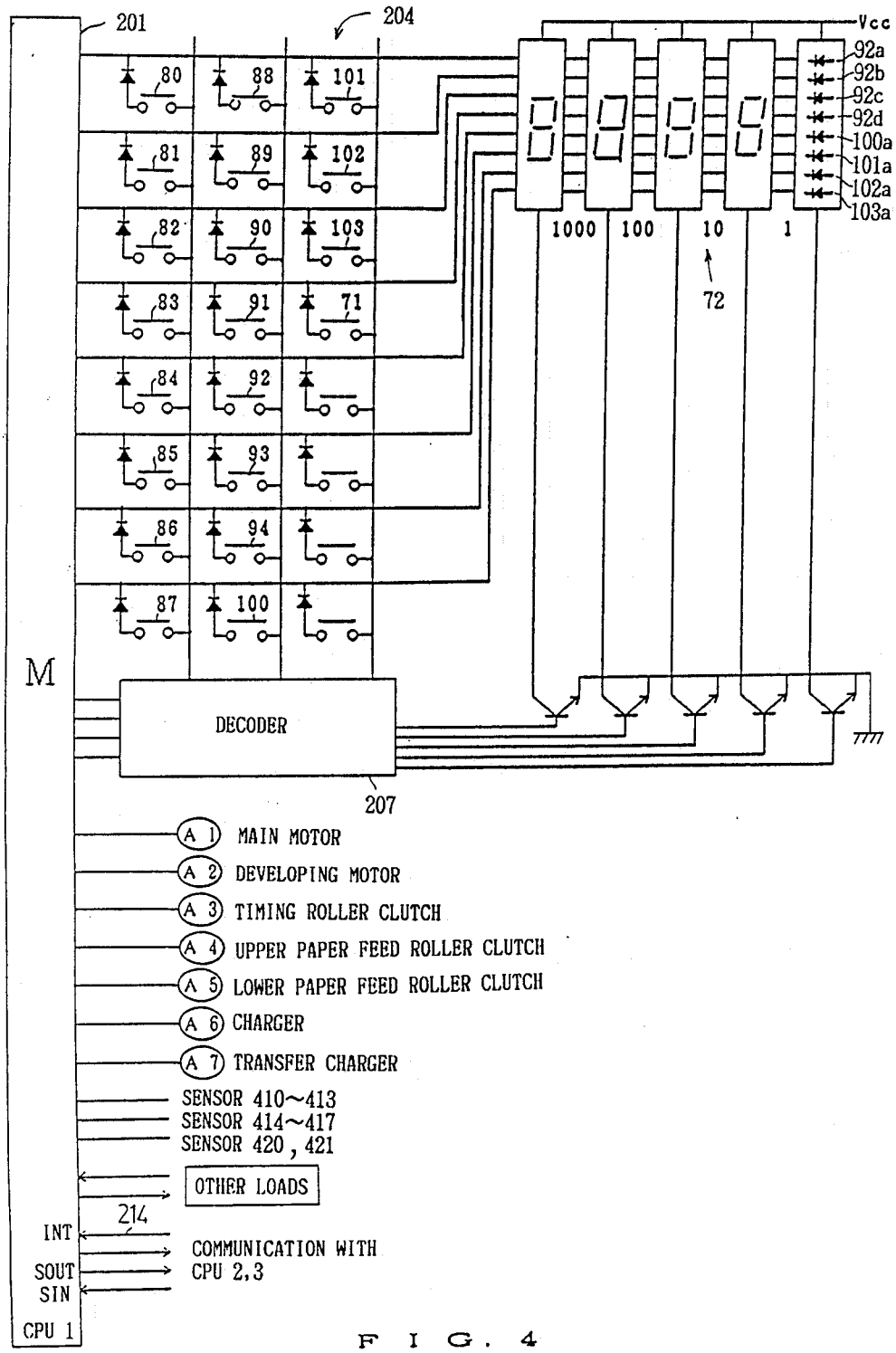
FIG. 4 is a block diagram showing the construction of a control system for the copying machine.

Groups of switches 410 to 413 and switches 414 to 417 are provided near the upper feed port and the lower feed port, respectively, so as to detect the paper size. These switches detect the size of the papers stored in the cassette 20 and 21, and the posture thereof with respect to the direction of feed, that is, whether they are in a longitudinal posture or lateral posture. Normally the copy sizes are A3, A4, A5, B4 and B5, and with the A4 and B5, a longitudinal posture and a lateral posture are selectable. The "longitudinal" means that the long side of a paper is in the direction of feed, whereas the "lateral" means that a short side is in the direction of feed. Switches 420 and 421 detect whether the cassettes 20 and 21 are loaded or not, which also tells whether the paper is present at the feed port or not. The size and posture of paper are detected in 4-bit code corresponding to the on/off operations of the switches 410 to 413 and 414 to 417, and stored in a RAM in a microcomputer (CPU1) (FIG. 4). One example of the codes for the switches 410 to 413 are shown in the following table, wherein the "on" is represented by 0, and "off" is by 1. When all the switches are off, it tells that the cassette 20 is not loaded, and that no paper is present:

TABLE

| decimal code | Binary Codes SW413 | SW412 | SW411 | SW410 | Paper Sizes |
|---|---|---|---|---|---|
| 0 | 0 | 0 | 0 | 0 | |
| 1 | 0 | 0 | 0 | 1 | |
| 2 | 0 | 0 | 1 | 0 | |
| 3 | 0 | 0 | 1 | 1 | |
| 4 | 0 | 1 | 0 | 0 | LO B5 |
| 5 | 0 | 1 | 0 | 1 | LO A4 |
| 6 | 0 | 1 | 1 | 0 | LO B4 |
| 7 | 0 | 1 | 1 | 1 | LO A3 |
| 8 | 1 | 0 | 0 | 0 | |
| 9 | 1 | 0 | 0 | 1 | |
| 10 | 1 | 0 | 1 | 0 | LA B5 |
| 11 | 1 | 0 | 1 | 1 | LA A4 |
| 12 | 1 | 1 | 0 | 0 | |
| 13 | 1 | 1 | 0 | 1 | |
| 14 | 1 | 1 | 1 | 0 | |
| 15 | 1 | 1 | 1 | 1 | Non-cassette |

LO: Longitudinal
LA: Lateral

Referring to FIG. 1, the reference numeral 300 designates a document feeder (DF) in an automatic document feeder (ADF). The document feeder 300 is provided with a sensor 310 which detects whether the document is supplied or not, and a sensor 311 which detects whether the document is present on a tray 304. The document feeder 300 is driven by a belt 305 caused to run by a motor (not shown) through pulleys, and the document is fed from the tray 304 by rollers 302 driven by another motor (not shown).

The copying operation starts by turning on a start key (print switch) 71 on an operation panel, which will be described below. A document is fed from the tray 304 by the feeder 300, and then placed on the glass panel 11, in the course of which its size is detected by the sensor 310 by measuring a period of time for which the sensor 310 responds to the passage of the document.

The ADF mode is set when the document feeder 300 is connected to the copying machine and the document is positioned on the tray 304. The document feeder 300 can be opened and closed by hand just like a cover, and a document can be placed on the glass panel by hand. In this manual mode the ADF mode is released, and the ordinary copying operation is performed. In the released ADF mode the document size can no longer be detected. If an automatic paper select mode and the enlarging divisional copying mode are already selected, they are also released. After the document is positioned on the glass panel 11 and the belt 305 stops, the copying machine 1 starts.

There are some copying machines which detect document sizes by differences in optical reflectivity or color between the document cover and the document. With these copying machines it is possible to omit the proceedings for releasing the modes.

The Operation Panels

Figure 2:
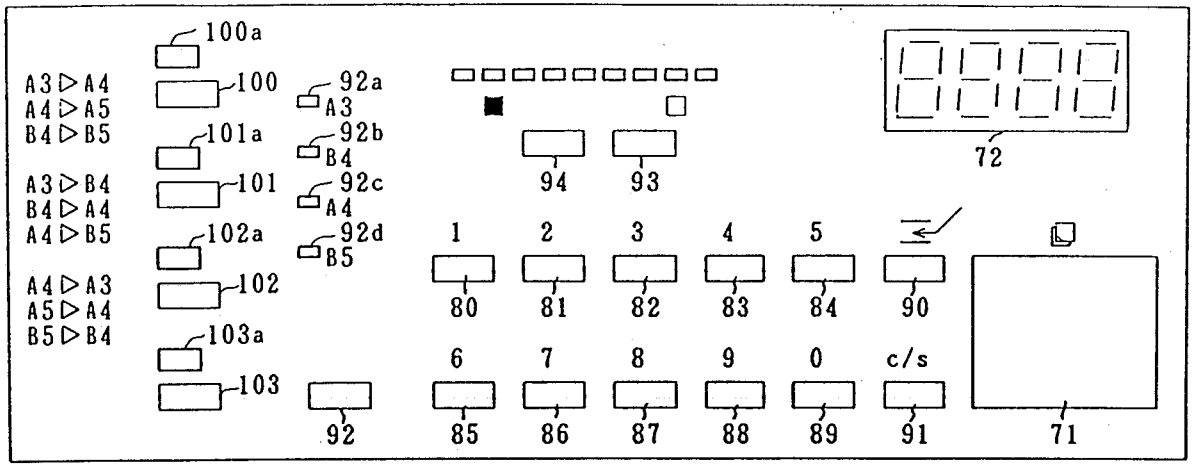
FIG. 2 is a plan view showing the operation panel of the copying machine.
Figure 3:
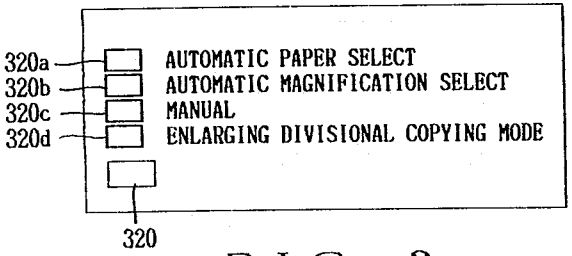
FIG. 3 is a plan view showing an operation panel of the ADF.

FIGS. 2 and 3 show operation panels for the copying machine 1 and an automatic document feeder, respectively. The operation panel shown in FIG. 2 is provided with the following keys and an indicator:

71: a print switch for starting the copying operation;
72: light-emitting diodes (LEDs) for indicating the number of papers copied or to be copied;
93, 94: up and down keys for increasing and decreasing the copy density, respectively;
80 to 89: ten keys corresponding to the numerical values of 1, 2, . . . 9 and 0;
90: an interrupt key for specifying an interrupt copying;
91: a clear/stop key for stopping the multicopying and clearing the numerical values;
92: a paper selection key;
92*a* to 92*d*: indicators for indicating the selection of the paper-size A3, B4, A4 and B5;
100: a selection key for reducing the paper size from A3 to A4;
101: a selection key for reducing the size from A3 to B4;
102: a selection key for magnifying the size from A4 to A3;
103: a selection key for 1-to-1 magnification;
100*a* to 103*a*: indicators for indicating the selection of the keys 100 to 103.

The operation panel mounted on the document feeder 300 shown in FIG. 3 is provided with a selection key 320. LEDs 320*a*, 320*b*, 320*c* and 320*d* indicate the selection of the automatic paper selecting mode, the automatic magnification selecting mode, the manual mode and an enlarging divisional copying mode, respectively. When the key 320 is turned on, the mode is varied, and a different LED illuminates.

The Construction of A Control System

FIG. 4 shows a control circuit for use in the copying machine 1, which comprises a microcomputer (CPU1) 201. A switch matrix 204 including keys 71, 80 to 94, 100 to 103, sensors 410 to 417, 420 and 421, and other loads are connected to respective input terminals. A four-digit indicator 72 and an LED matrix 92*a* to 92*d* and 100*a* to 103*a* are connected to respective output terminals, which are driven by the CPU1 through a decoder 207. The output terminals output signals for driving the main motor, developing motor, timing roller clutch, upper paper feed roller clutch, lower paper feed roller clutch, charger and transfer charger, and other loads. A bus 214 is provided for communication with other microcomputers CPU2 and CPU3.

FIG. 5(1) shows the input/output construction of a microcomputer (CPU2) 202 for controlling the optical system. Input/output ports of the CPU2 are connected to a control 205 for controlling a scanning motor M3 and a control 206 for controlling a motor M4 which moves the lens 16. Signals are input from a switch SW50 for positioning the optical system and a switch SW51 for generating timing signals to start the timing rollers 26 when no magnification is intended. The CPU 2 communicates with the CPU1 through the bus 214.

FIG. 5(2) shows the input/output construction of a microcomputer (CPU3) 203 for controlling the document feeder 300. The CPU3 generates signals to the motor 301 for driving the conveyor belt, and the motor 302 for feeding the papers, and receives signals from the document feeder sensor 310 and the document detecting sensor 311. Selection keys and indicators (LEDs) 320*a*, 320*b*, 320*c* and 320*d* on the operation panel shown in FIG. 3 are connected to the CPU3, which communicates with the CPU1 through the bus 214.

Operation of The Copying Machine

The control program for controlling the copying machine by the CPU1 will be described:

(a) Main Routine

FIG. 6 is a flowchart showing a main routine for the CPU1. The CPU1 is reset, and the program starts. In step #1 the initialization, including the clearing of the RAM, the setting of registers, etc. is done.

In step #1 the internal timer in the CPU1 is set, and started in step #2. In steps #3, #4 and #5 the subroutines shown in the flowchart are consecutively called into action. When all the sub-routines are finished, the sequence ends and returns to step #2 upon completion of operation of the internal timer. By using the period of time taken in one routine, the times are calculated for the timers used in the subroutines; more specifically, the completion of operation of each timer is determined by calculating how often this routine is counted.

(b) Copying Operation

A routine S3 for the copying operation is shown in FIGS. 7(1), 7(2), 7(3) and 7(4).

Referring to FIG. 7(1), in step #60 when the print switch 71 is on edge, the sequence advances to step #61. If the ADF is not relied upon, the copy start flag is turned "1" in step #62. In step #61 when the ADF is relied upon, a signal for starting the ADF is turned "1" (step #64) if the document is present on the tray of the ADF (step #63).

When the print switch 71 is not on edge (step #60), the sequence advances to step #65. If the ADF is relied upon, and the document position signal from the ADF is "1" in step #66, the sequence advances to step #67. If the ADF mode is an automatic paper selecting mode, the automatic paper selecting routine is called into action (step #68), If the size inadequacy flag is "0" (step #69), the sequence advances to the next step. However, if it is "1", an LED indicator 320*c* is turned on, and indicators 320*a*, 320*b* and 320*d* are turned off (step #74). The ADF mode is automatically switched to the manual mode.

If the enlarging divisional copying mode is selected (step #70), a routine for setting the enlarging divisional mode is called into action (step #71). As a result, if the divisional inadequacy flag is "0" (step #72), the copy start flag is turned "1". If the inadequacy flag is "1" (step #72), the LED indicator 320*c* is turned on, and the indicators 320*a*, 320*b* and 320*d* are turned off (step #75). The enlarging divisional mode is switched to the manual mode.

The subsequent development is shown in FIGS. 7(2), 7(3) and 7(4):

In FIG. 7(2) step #530 checks whether a copy start flag is "1" or not. If it is "1", in step #531 the main motor, developing motor, charger, and transfer charger are driven. The flag is turned "0", and the timers T-A and T-B are set.

The timer T-A is to control the time for which the clutch CL2 or clutch CL3 is in operation, thereby regulating the adequate feeding of paper. The timer T-B is to control the time taken from the turning-on of the key switch 71 up to the generation of a scan signal such that the scanning of the document starts when the paper reaches a designated position.

In steps #532 to #535 the upper cassette 21 or the lower cassette 22 is selected. If the upper cassette 21 is selected, the feed roller clutch CL2 is turned on, and if the lower cassette 22 is selected, the clutch CL3 is turned on. Step #536 checks a timer T-A for feeding the paper. Upon completion of operation of the timer T-A, the clutch CL2 or CL3 is turned off (step #537).

Step #538 checks a timer T-B. Upon completion of operation of the timer T-B a scan signal indicates that the optical system is allowed to scan (step #539).

In FIG. 7(3) in steps #547 and #548 the paper is stopped at the timing rollers 26, and waits for a timing signal generated in response to the movement of the scanning optical system. The clutch CL1 is put into operation synchronously with the generation of the timing signal, thereby ensuring that the leading edge of the paper coincides with the leading edge of the image. In step #548 a timer T-C is set.

In steps #549 and #550 when the time counted by the timer T-C from the generation of the timing signal lapses, the charger is turned off, the scanning signal is turned "0" and the timing roller clutch CL1 is turned off.

Step #551 checks whether a return signal is "1" or not, wherein the signal is generated when the scanning optical system is about to return to the original position, and if the system is on the way back, step #552 checks whether the number of copies previously set are finished or not. If they are not finished, the copy start flag is turned "1" and the sequence advances to step #556. If step #552 finds that the multi-copies are finished, the developing motor and transfer motor are turned off upon reception of a position signal "1" generated when the scanning optical system returns to the original position (step #553), and also a timer T-D is set for discharging a copied paper. The timer T-D holds the time for which a copied paper is discharged from the copying machine.

In FIG. 7(4) step #555*a* checks whether the multicopies are finished or not. If it is finished, the sequence advances to step #556, and if otherwise, step #555*b* checks whether the book divisional copying mode is selected or not. If it is not selected, the sequence advances to step #556, and if it is selected, step #555*c* checks whether a signal for copying a page (B) of the book is "1" or not. If it finds that the signal is "1", the signal is turned "0", and a signal for copying a page (A) of the book it turned "1". A copy start flag is set to "1" (step #555*d* to 555*f*), and the sequence advances to step #556. If step #555*c* finds that the signal for copying the page (B) is not "1", the signal for copying the page (A) is turned "0"(step #555*g*), and then the signal for copying the page (B) is turned "1" (step #555*h*), and the sequence advances step #556. When step #556 finds that the operation of the timer T-D ends, step #557 stops the main motor, and step #558 outputs the results of the processes, and then the sequence returns to the main routine.

(c) Automatic Paper Selection

Figure 8:
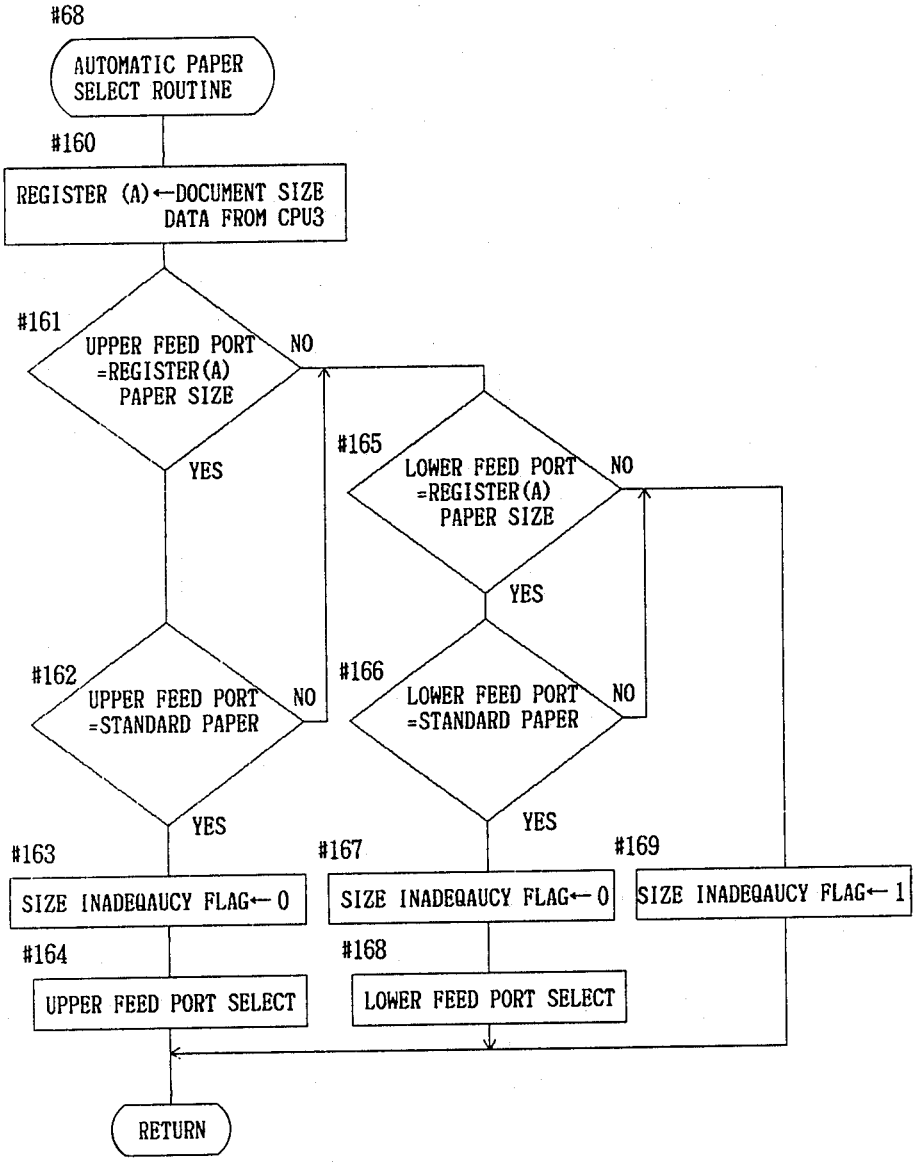
FIG. 8 is a flowchart showing a subroutine for the automatic paper selection.

FIG. 8 is a flowchart showing an automatic paper selecting routine step #68. Step #160 stores the data about a paper size sent from the CPU3 in a register (A). The data stored in the register (A) is compared with the paper size in the upper cassette 20 (step #161). If the sizes are the same and the papers are found to be a standard paper by the sensors 401 and 402 (step #162), the size inadequacy flag is turned "0" (step #163), and the upper paper feed port is selected (step #164). If the data stored in the register (A) is found different from the paper size in the cassette 20 (step #161), the papers in the lower cassette 21 are compared(step #165). If the sizes are equal and the qualities are both standard, which is detected by the sensors 403 and 404 (steps #165, #166), the size inadequacy flag is turned "0" (step #167), and the lower paper feed port is selected (step #168). If the paper size signalled is neither equal to that of the papers in the upper paper feed port nor the lower paper feed port, the flag is turned "1" (step #169).

(d) Setting of An Enlarging Dividing Copying Mode

Figure 9:
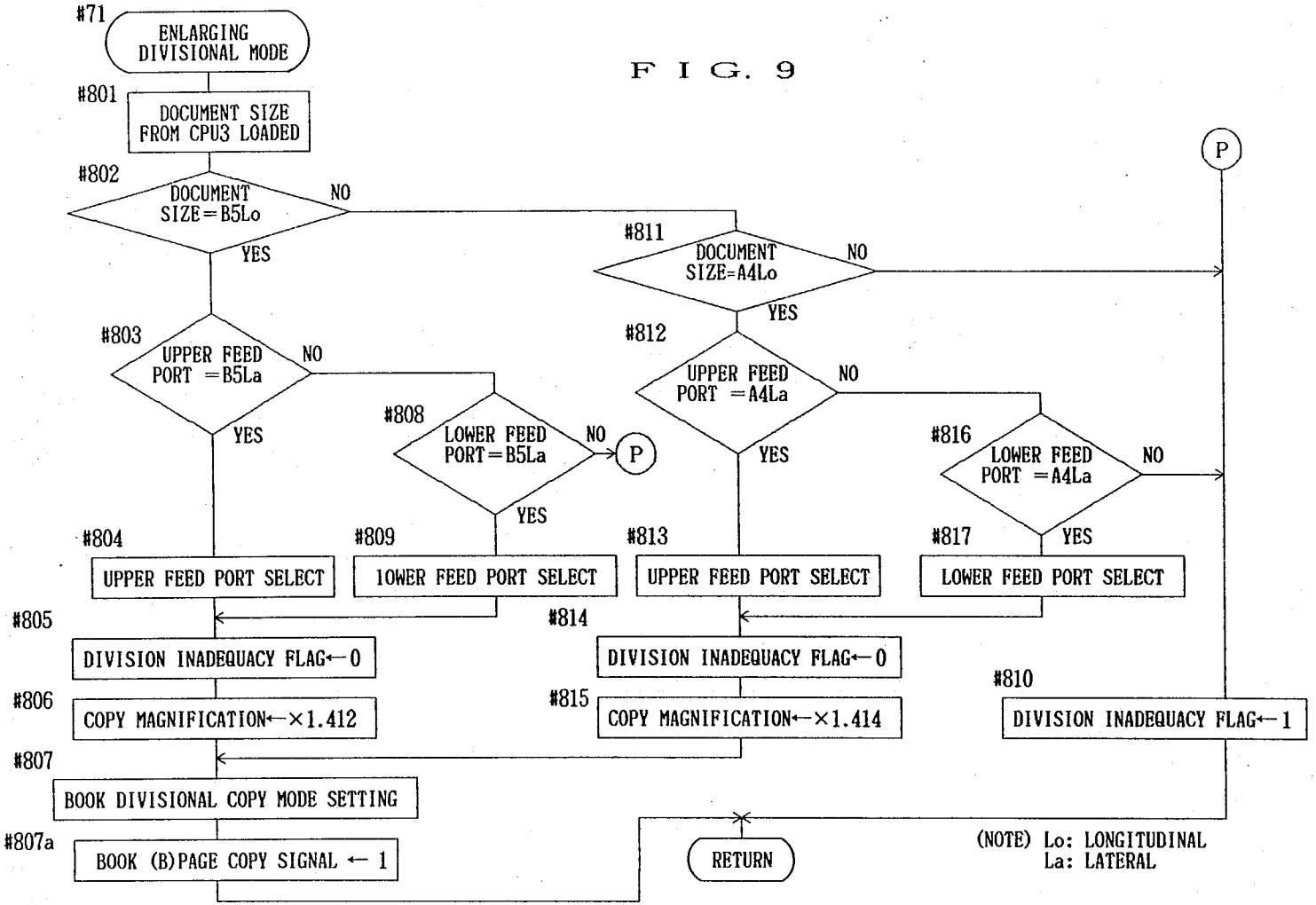
FIG. 9 is a flowchart showing an enlarging divisional copying mode.

FIG. 9 is a flowchart showing a routine step #71 for setting up an enlarging divisional mode. The document size detected in ADF is loaded from the CPU3 (step #801). If the document size is a longitudinal B5 (step #802), the paper present at the upper feed port is checked as to whether its size is longitudinal B5 or lateral B5 (step #803). Herein the "longitudinal" means that the long side of the paper is in the direction of feed, whereas the "lateral" means that the short side is in the direction of feed. If step #803 finds that the paper at the upper feed port is a lateral B5 size, the upper feed port is selected (step #804), and the division inadequacy flag is turned "0" (step #805). In addition, the magnification is set to 1.412 (step #806), and then a book divisional copying mode is set (step #807).

If step #803 finds that the paper present at the upper feed port is not a lateral B5, the paper at the lower feed port is checked as to whether it is a lateral B5 or not (step #808). If it is a lateral B5, the lower feed port is selected (step #809), and if otherwise, the division inadequacy flag is turned "1" (step #810).

If step #802 finds that the document is not a longitudinal B5, the size of the document is checked as to whether it is a longitudinal A4 or not (step #811). If it is a longitudinal A4, the paper at the upper paper feed port is checked as to whether it is a lateral A4 or not (step #812). If it is a lateral A4, the upper paper feed port is selected (step #813), and the division inadequacy flag is turned "0" (step #814). In step #815 the magnification is set to 1.414, and in step #807 and the book divisional copying mode is set.

If step #812 finds that the size of the paper present at the upper feed port is not a lateral A4, step #816 checks whether the paper size at the lower feed port is a lateral A4. If it is a lateral A4, the lower paper feed port is selected (step #817), and the sequence consecutively advances to steps #814, #815 and #807. After advancing to step #807, the sequence advances to step #807*a* where the signal for copying the page (B) is turned "1".

If step #816 finds that the paper size at the lower feed port is not a lateral A4, the division inadequacy flag is turned "1" (step #810).

Herein, the book divisional copying means that facing pages of a book are respectively copied on one page in a copying operation effected by one touch of the starter. In other words, an original is copied ½ by ½ on a single page.

The Operation of An Optical system

Figure 10:
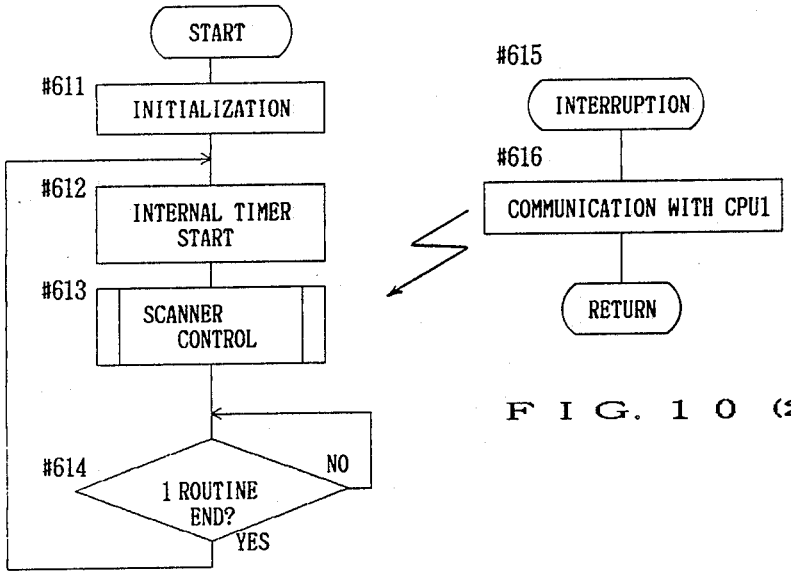
FIGS. 10 (1) and 10(2) are flowcharts showing main routines executed by a CPU2 for controlling the optical system.
Figure 11:
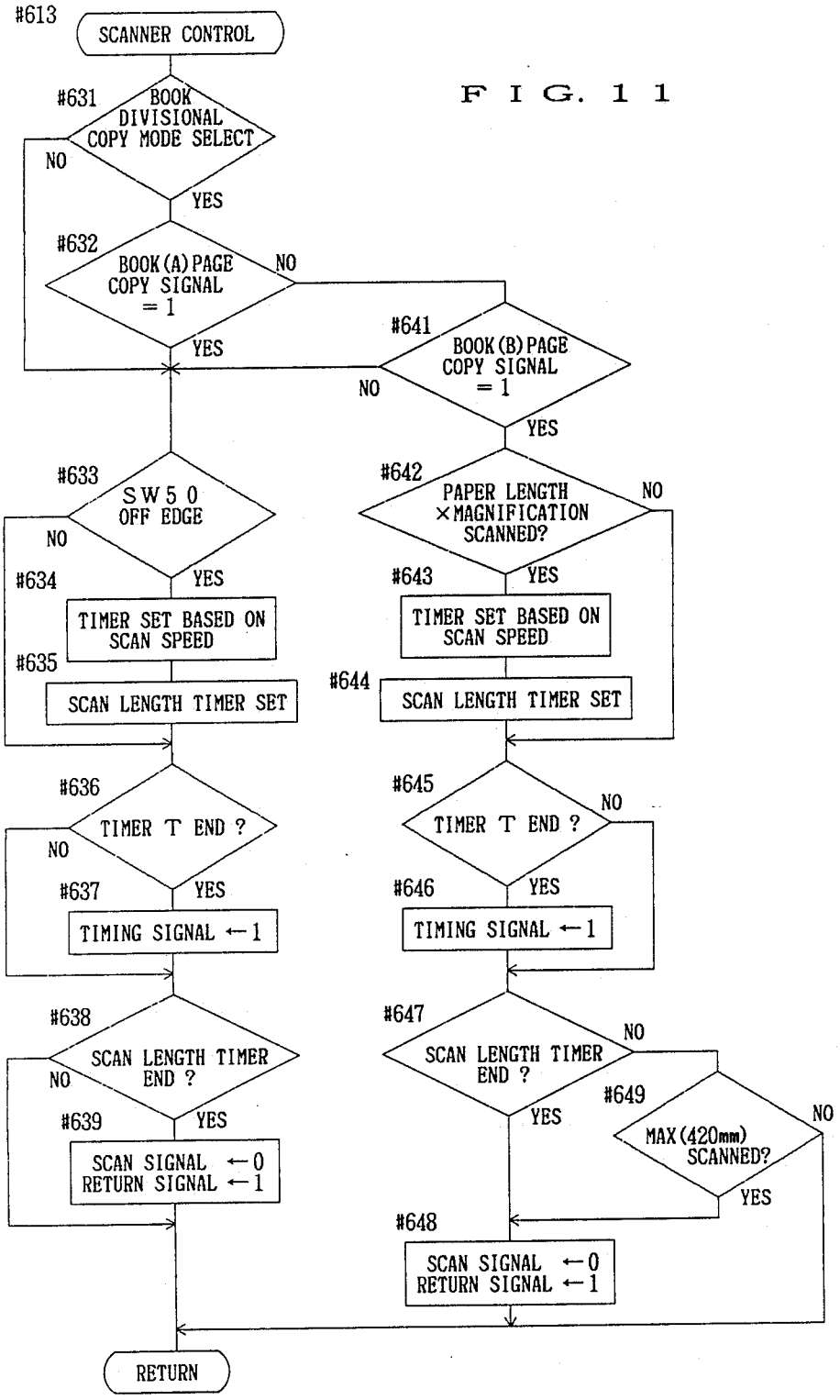
FIG. 11 is a flowchart showing a subroutine for controlling the scanner.

FIGS. 10 (1), 10(2) and FIG. 11 are flowcharts showing a program for a microcomputer CPU2 202 for controlling the optical system. In a main routine (FIG. 10(1) the initialization is done in step #611. Then the internal timers are started (step #612). In step #613 a subroutine is called into action. In the subroutine the optical system control is handled as shown in FIG. 11. When step #614 finds that one routine is finished, the sequence returns to step #612.

As shown in FIG. 10(2), if an interruption is caused by CPU1 (step #615), a data communication is conducted between CPU1 and CPU2 (step #616).

FIG. 11 shows a scanner control routine step #613. When a book divisional copying mode is not set (step #631), that is, an ordinary copying mode is set, or, when a book divisional copying mode is set and a signal for copying a page (A) of a book is turned "1" (step #632), an ordinary scanning is done. More specifically, when the scanner goes away from a scanner positioning switch SW50 (step #633), a timer T and a scan length timer are set (steps #634, #635). The timer T is to coincide the scanning with the paper feeding by taking the scaning speed into consideration, and the scan length timer is to set a length derived by multiplying the length of paper by the magnification. Upon completion of operation of the timer T (step #636) the timing signal is turned "1" (step #637). Upon completion of operation of the scan length timer (stp #638) the scanning signal is turned "0", and the return signal is turned "1" (step #639). In the book divisional mode where a signal for copying another page (B) is turned "1" (step #641) after a length derived by multiplying the paper length by the magnification is scanned (step #642), the same sequence as mentioned above is executed (steps #643 to #648). If the scan length reaches the maximum value (420 mm) before the operation of the scan length timer ends, the scanning is finished (steps #649, #648), and the sequence returns. As shown in FIG. 12, in the book dividing copying mode the page (B) is scanned first, and then the page (A) is scanned.

Automatic Document Feeder

Referring to FIGS. 13(1) to 18, a microcomputer (CPU3) 203 for controlling the document feeder 300 will be described:

As shown in FIG. 13(1), the CPU 3 is reset, and the program starts. Then the initialization, including the clearing of the RAM and the setting of various registers, is done (step #651).

In step #652 the internal timer in the CPU3 and having values predetermined at the initialization is started.

Subroutines for effecting a document control (step #653), a document size detection (step #654) and a mode selection (step #655) are consecutively called into action. When all the subroutines are finished, one routine is finished upon completion of the operation of the timer initially set (step #656). The operation time of each timer used for the subroutine is counted by reference to the period of time of this routine. The completion of operation of each timer is judged by calculating how often this routine is counted.

As shown in FIG. 13(2), a data communication with CPU1 (step #658) is conducted by a request for interruption from CPU1, regardless of the main routine.

Figure 14:
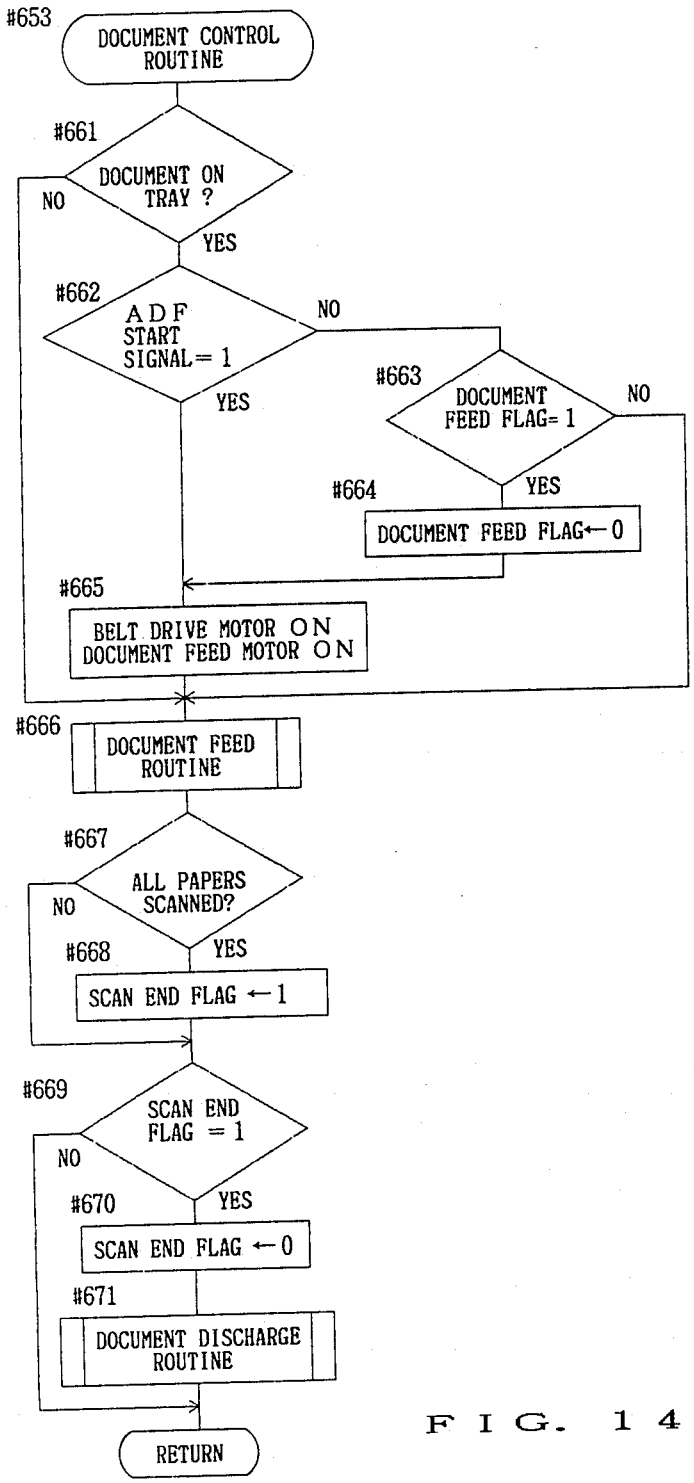
FIG. 14 is a flowchart showing a subroutine for controlling an original document.

FIG. 14 shows step #653 for executing a document control routine. Under the condition that a document is present on the tray of the ADF (step #661) (accordingly, the document detecting sensor 311 is on), if an ADF start signal from CPU1 is "1" (step #662) or if the ADF start signal is "0" but a document feed flag is "1" (step #663), the motor 301 for driving the conveyor belt, and the motor 302 for feeding the document are turned on (step #665) after the document feed flag is turned "0" (step #664).

Subsequently, the document feed routine follows (step #666). When a predetermined number of documents are repeatedly scanned (step #667), a scan end flag is turned "1" (step #668).

Figure 16:
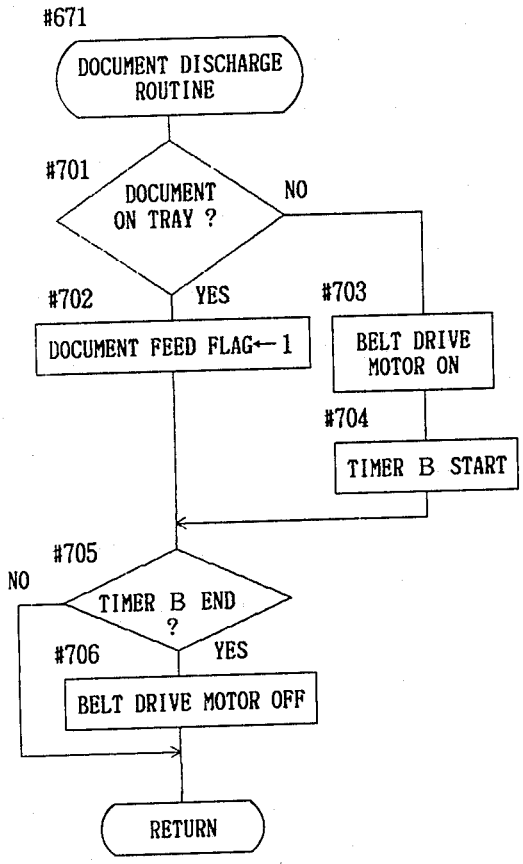
FIG. 16 is a flowchart showing a subroutine for discharging the document out of the copying machine.

In step #669 when the scan end flag is "1", it is turned "0" (step #670) and the document discharge routine is executed (step 671) as shown in FIG. 16.

Figure 15:
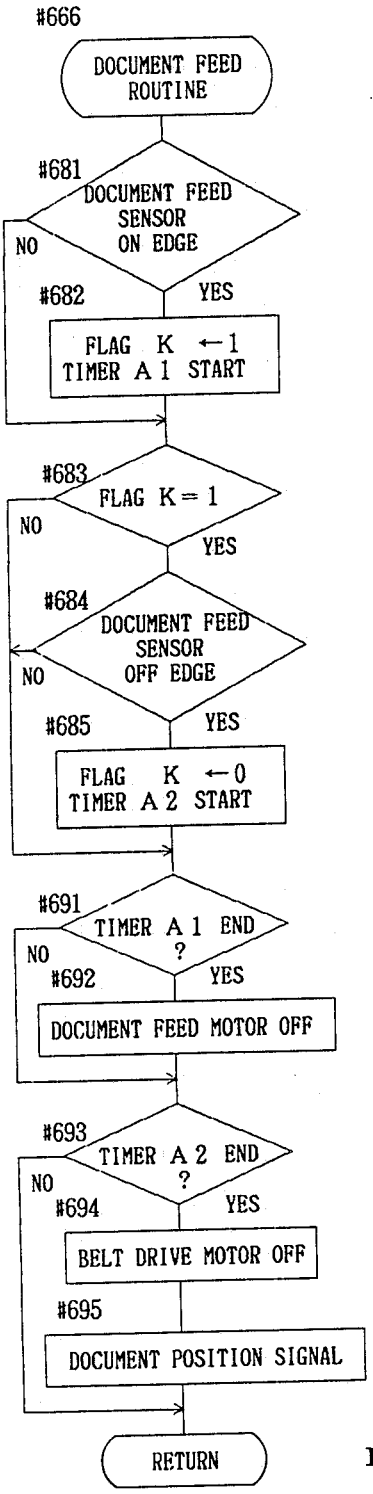
FIG. 15 is a flowchart showing a subroutine for feeding the document.

FIG. 15 is a flowchart showing step #666 for executing the document feed routine. When the sensor 310 is turned on in response to the supply of the document (step #681), the flag K is turned "1", and the timer A1 is started (step #682). This timer A1 is to stop the motor 302 so as to prevent the next document from following the preceeding one. The time is set so that it lasts until the document comes to a position where it is driven by the conveyor belt 305.

When the flag K is "1" (step #683) and if the sensor 310 is off edge, that is, it detects the trailing edge of the document (step #684). the flag K is turned "0", and the timer A2 is started (step #685). The value of the timer A2 is set to a time for which the trailing edge of the document reaches a predetermined position the leading portion of the glass panel.

Upon completion of operation of the timer A1 (step #691), the motor 302 stops (step #692). Upon completion of operation of the timer A2 (step #693) the motor 301 stops (step #694), and a document position signal is delivered to CPU1 (step #695).

FIG. 16 is a flowchart showing step #671 for executing a document discharge routine. If the sensor 311 detects that the next document is placed on the tray (step #701), the document feed flag is turned "1" (step #702). If otherwise, the motor 301 is rotated in a clockwise direction (step #703), and a timer B is started (step #704). A time is set by the timer B so that a document (the longest document) placed on the glass panel can be discharged for this period of time. Upon completion of operation of the timer B (step #705) the motor 301 is turned off (step #706).

Figure 17:
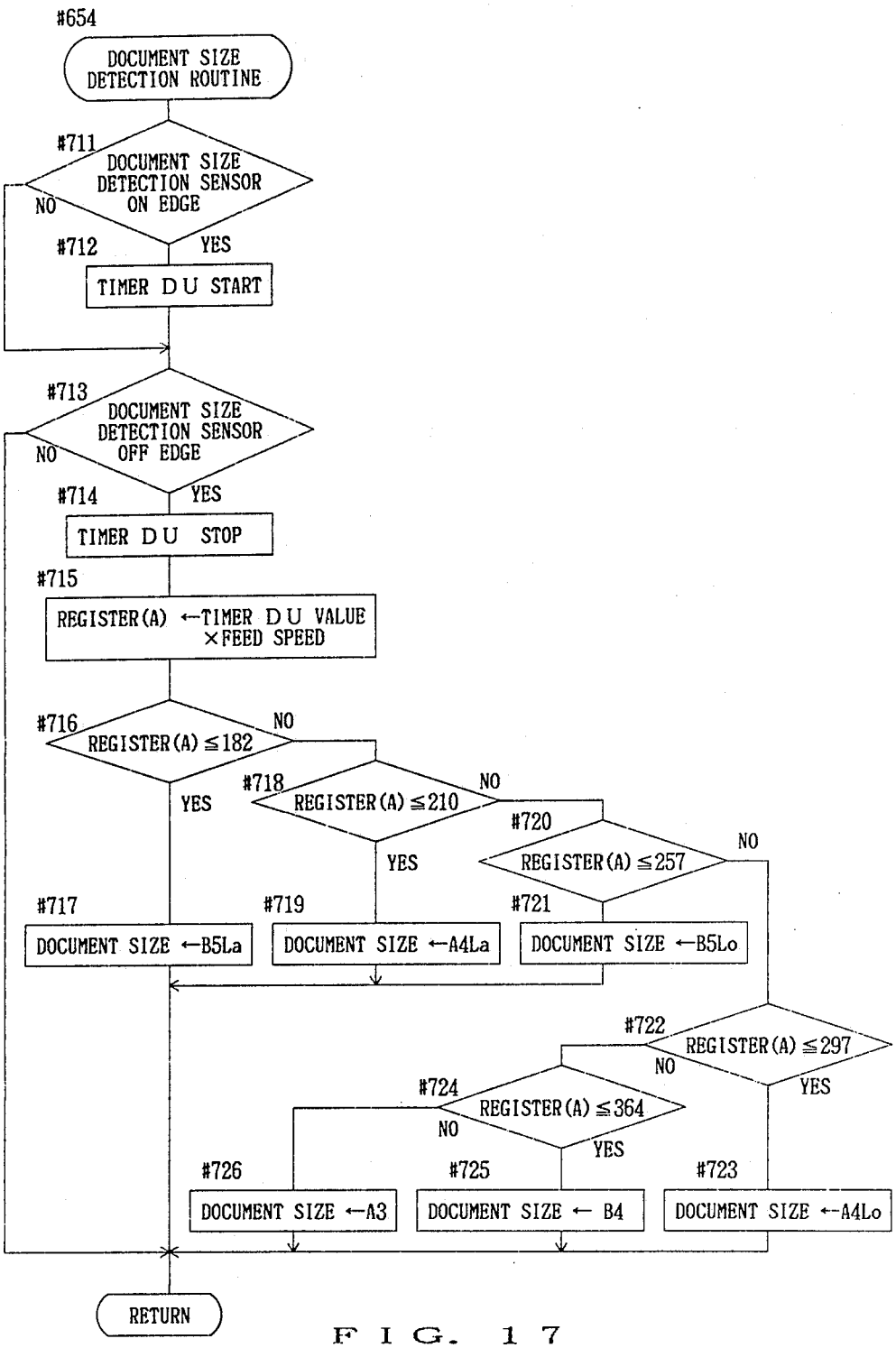
FIG. 17 is a flowchart showing a subroutine for detecting the document size.

FIG. 17 is a flowchart showing a subroutine step 654 for detecting a document size. In step #711 when the sensor 310 is on edge a timer DU is started (step #712). In step 713 when the sensor 310 is off edge, that is, when the trailing edge of the document passes, the timer DU is stopped (step #714). At this stage, the length of the document derived by multiplying the time by the document feeding speed is stored in a register (A) (step #715). The relationship between the length stored in the register (A) and the document size is judged as follows:

| Length(mm) | Step # | Size | Step # |
|---|---|---|---|
| 182 or less | 716 | La B5 | 717 |
| 210 or less | 718 | La A4 | 719 |
| 257 or less | 720 | Lo B5 | 721 |
| 297 or less | 722 | Lo A4 | 723 |
| 364 or less | 724 | B4 | 725 |
| more than 364 | | A3 | 726 |

(Note) La stands for lateral, and Lo stands for longitudinal.

To secure accurate determination, a further sensor is preferably provided near the sensor 310 so as to detect the width of the document. The employment of two sensors is advantageous in distinguishing between papers having the same length but different widths, such as lateral A4 and longitudinal A5.

Figure 18:
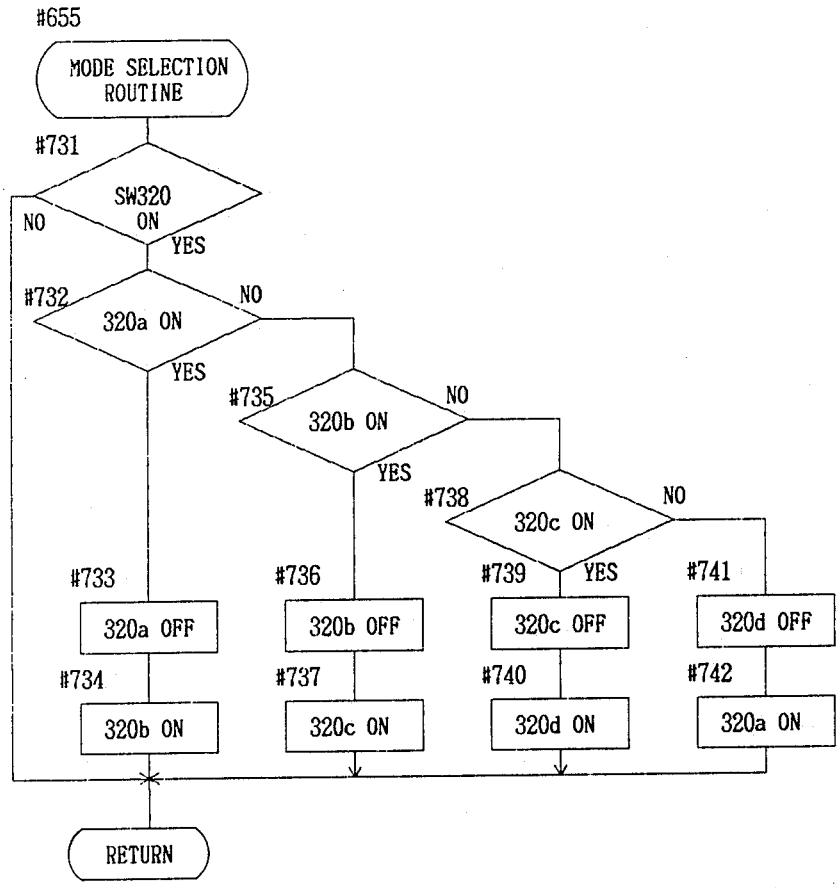
FIG. 18 is a flowchart showing a subroutine for selecting the modes.
Figure 19:
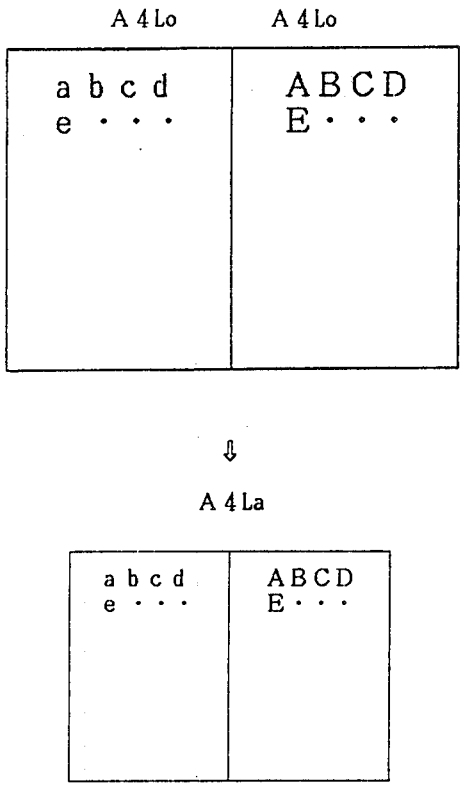
FIG. 19 is a schematic view showing that the letters of two longitudinal A4 papers placed side by side are copied on a single lateral A4 paper on a reduced scale.

FIG. 18 is a flowchart showing a mode selection routine (step #655) (FIG. 13(1)). When the mode selection switch 320 (FIG. 3) is turned on, the switch on edge (step #731) illuminates the LED 320*a*. That is, if the automatic paper selecting mode is selected (Step #732), an automatic magnification selecting mode is set (steps #733, #734). A switch 320 on edge illuminates LED 320*b*. That is, if an automatic magnification selecting mode is selected (step #735), a manual mode is set (steps #736, #737). The switch 320 on edge illuminates LED 320*c*. That is, if the manual mode is selected (step #738) an enlarging dividing copying mode is set (steps #739, #742). In any other case the automatic paper selecting mode is set (steps #741, #742).

As is evident from the foregoing, in the illustrated embodiment the ADF is relied upon, and the key switch 320 is operated on the operation panel of the ADF to set an enlarging divisional copying mode. Thus the mere operation of the print switch 71 (start switch) makes it possible to magnify a reduced image on a single paper so as to copy it on separate pages on the original scale. It is also possible for facing two pages of a book to be magnified into respective single page on an enlarged scale. In the illustrated embodiment the scanning is executed on two parts of a document, that is, a first half portion and a second half portion, but it is of course possible to scan three or more parts of the document.

What is claimed is:

1. A copying machine which comprises:
a rotatable photosensitive member;
means for supporting a document for copying;
a scanning means for scanning the document positioned on the supporting means, wherein the document is scanned either in a first mode in which a first half portion and a second half portion thereof in the scanning direction are separately scanned so as to form the image of each portion on the photosensitive member, or in a second mode in which the entire surface of the document is scanned so as to form an image thereof on the photosensitive member;
means for varying a magnification of the image formed on the photosensitive member;
at least two cassettes for containing copy papers of various sizes;
means for detecting the sizes of the papers contained in each cassette;
means for detecting the size of the original document;
means for selecting an enlarging divisional copying mode so as to divide an image of the document into two parts and copy each part on an enlarged scale; and
control means operable upon selection of the enlarging divisional copying mode by the selecting means, for automatically setting a magnification and a paper size corresponding to the document size detected by the document size detecting means, and for copying the images of the first half portion and the second half portion of the document on separate papers in the first scan mode.

2. A copying machine as defined in claim 1, further comprising a document feeding means for transporting and positioning a document on the supporting means, wherein the document size detecting means detects the document size while the document is transported.

3. A copying machine as defined in claim 2, wherein the document size detecting means includes a sensor disposed on the document feeding means, the sensor being adapted to respond to the passage of the document.

4. A copying machine as defined in claim 1, further comprising a document feeding means for transporting and positioning a document on the supporting means, and wherein the means for selecting an enlarging divisional copying mode is executable when the document feeding means is used.

5. A copying machine as defined in claim 4, wherein the means for selecting an enlarging divisional copying mode comprises a mode selection key disposed on the document feeding means.

6. A copying machine as defined in claim 1, wherein the paper size selected in the enlarging divisional copying mode is equal to the size of a document.

7. A copying machine as defined in claim 1, wherein the scanning means includes a scanner having a light source for irradiating a light upon the document, the scanner reciprocally moving along the entire surface of the document from a reference position to scan the first portion thereof, and reciprocally moving along the second portion thereof from the reference position to scan the second portion in the first scan mode.

8. A copying machine as defined in claim 1, wherein the paper size detecting means includes a plurality of switches alternatively operable in response to particular paper sizes in the cassettes, thereby detecting the paper size through and on-and off-operations thereof.

9. A copying machine as defined in claim 4, further comprising at least either a first means for selecting a mode in which a paper is automatically selected for copying, the paper having a size corresponding to that of the document detected by the document size detecting means, or a second means for selecting a mode in which a paper is manually selected for copying, wherein either the first or the second mode selecting means and the means for selecting the enlarging divisional copying mode include a common mode selection key.

10. A copying machine as defined in claim 9, wherein the mode selection key is included in the document feeding means.

11. A copying machine as defined in any of claims 1 to 10, wherein the paper size detecting means includes means for detecting whether the paper takes a longitudinal posture or a lateral posture in the cassettes with respect to the direction of paper feed.

* * * * *